United States Patent [19]

Nicholas

[11] Patent Number: 4,743,036

[45] Date of Patent: May 10, 1988

[54] COMPRESSION SEAL

[75] Inventor: John D. Nicholas, Lawrenceville, Ga.

[73] Assignee: MM Systems Corporation, Tucker, Ga.

[21] Appl. No.: 852,761

[22] Filed: Apr. 16, 1986

[51] Int. Cl.[4] ..... E01C 11/10; F16J 15/10

[52] U.S. Cl. ..... 277/237 R; 52/396; 52/403; 277/205; 277/207 R; 404/64; 404/65

[58] Field of Search ..... 277/237 R, 205, 207 R; 52/396, 403; 404/64, 65; 405/135

[56] References Cited

U.S. PATENT DOCUMENTS

| | | | |
|---|---|---|---|
| 2,230,303 | 2/1941 | Leguillon | 404/65 |
| 3,179,026 | 6/1964 | Crone . | |
| 3,276,336 | 4/1964 | Crone . | |
| 3,358,568 | 5/1964 | Brown . | |
| 3,394,640 | 7/1968 | Dreher | 52/396 X |
| 3,485,149 | 12/1969 | Boney | 52/396 X |
| 3,521,528 | 3/1970 | Wangerow . | |
| 3,603,055 | 9/1971 | Dale | 404/65 |
| 3,606,826 | 7/1969 | Bowman . | |
| 3,645,176 | 9/1969 | Berchou . | |
| 3,653,305 | 4/1972 | Trieste et al. . | |
| 3,687,022 | 8/1972 | Brown | 404/64 |
| 3,762,826 | 10/1973 | Bowman | 404/64 |
| 3,765,784 | 10/1973 | Watson et al. | 404/64 |
| 3,776,654 | 12/1973 | Brown | 404/65 |
| 3,881,834 | 5/1975 | Bowman . | |
| 3,900,677 | 8/1975 | Barber . | |
| 3,967,911 | 7/1976 | Miers | 52/396 X |
| 4,043,693 | 8/1977 | Brown . | |
| 4,063,840 | 12/1977 | Fordyce et al. | 52/396 X |
| 4,098,043 | 7/1978 | McCready . | |
| 4,119,387 | 10/1978 | Brown . | |
| 4,148,167 | 4/1979 | Puccio . | |
| 4,362,428 | 12/1982 | Kerschner | 52/396 X |
| 4,437,785 | 3/1984 | Puccio . | |
| 4,457,522 | 7/1984 | Trieste et al. | 404/64 X |
| 4,616,460 | 10/1986 | Nicholas | 277/205 X |

FOREIGN PATENT DOCUMENTS

| | | | |
|---|---|---|---|
| 1459687 | 12/1968 | Fed. Rep. of Germany | 404/64 |
| 2054095 | 5/1972 | Fed. Rep. of Germany | 404/64 |
| 2253140 | 12/1973 | Fed. Rep. of Germany | 404/64 |

*Primary Examiner*—Allan N. Shoap

*Attorney, Agent, or Firm*—Jones, Askew & Lunsford

[57] ABSTRACT

An elastomeric compression seal for sealing expansion grooves in bridges or the like. The seal comprises a plurality of congruently linked cells having vertical side walls and convex upper walls. The seal is characterized by a controlled collapse which prevents the convex upper walls from elongating upwardly upon lateral compression of the seal. This controlled collapse is accomplished by downwardly extending V-shaped walls connected at their upper edges to the vertical walls. As the seal is compressed, the V-shaped walls collapse such that their apexes are displaced downwardly. This downward force is transmitted to the central portion of the convex upper walls by vertical connectors to negate the tendency of the convex walls to distort upwardly upon compression.

8 Claims, 2 Drawing Sheets

COMPRESSION SEAL

TECHNICAL FIELD

The present invention relates generally to extruded compression seals for sealing expansion grooves in bridges or the like, and relates more specifically to a seal comprising a multiplicity of linked cells which collapses in a controlled manner to provide a substantially planar upper surface.

BACKGROUND OF THE INVENTION

Extruded elastomeric compression seals for filling expansion joints in bridges, parking decks, and the like are well known in the art. Typically, such a seal will be installed within the void between adjacent concrete slabs to absorb thermal expansion of the adjacent slabs while preventing moisture and debris from penetrating the joint.

In addition to forming a tight seal between the adjacent structures, it is important that the seal collapse in such a manner that it does not distort upwardly to protrude above the upper surfaces of the adjacent structures. When the seal protrudes upwardly from the joint, pedestrians might trip on the protrusion, or snow plows might catch the seal and damage it or disengage it from the expansion joint. Accordingly, there is a need to provide a compression seal which collapses in response to thermal expansion of the adjacent structures in a controlled manner so as not to protrude upwardly of the joint.

A further consideration in the design of such compression seals is that they provide a substantially planar upper surface acceptable for pedestrian traffic. Accordingly, many prior art seals designed to collapse downwardly upon compression, while acceptable for vehicular traffic, might be totally unsuited for pedestrian traffic since the high heels of womens' shoes can easily become caught in the depression, causing a potential pedestrian hazard.

Accordingly, there is a need to provide a compression seal which maintains a substantially planar upper surface at all points during its compression.

Several previous efforts have been made to design a seal to provide a substantially planar upper surface, but with limited success. Generally, the approach has been to provide a plurality of substantially planar upper wall sections separated by V-shaped indentations. Examples of such seals are shown in U.S. Pat. Nos. 4,098,043, 4,148,167, 3,276,336, and 4,043,693. As these seals are compressed, the V-shaped indentations separating the planar upper wall sections close. Thus, in their compressed configuration, these seals succeed in providing a continuous, substantially planar upper treadway. However, upon thermal contraction of the adjacent structures, the seal expands, causing the V-shaped indentations to open. Thus, when these seals are in a partially compressed configuration, womens' high heels can easily become lodged in the V-shaped indentations.

SUMMARY OF THE INVENTION

As will be seen, the present invention overcomes these and other problems associated with the prior art compression seals. Stated generally, the present invention comprises an elastomeric extrusion for installation in an expansion joint in a bridge or the like, which collapses in a controlled manner to maintain a substantially planar upper surface suitable for pedestrian traffic. The seal is designed so, as not to distort upwardly as it is compressed, so that the seal does not protrude upwardly of the joint where it may serve as a hazard to pedestrians or be damaged or dislodged by a snow plow or the like.

Stated more particularly, the improved compression seal of the present invention comprises a plurality of identical cells congruently disposed in side-by-side relation. Each cell has a substantially semicircular upper wall. To counteract the tendency of the convex upper walls to deform vertically into an eliptical shape upon compression, internal V-shaped walls designed to collapse inwardly upon lateral compression of the seal are linked to the central portions of the upper walls. Thus, as the seal is compressed, the downward force generated by the collapse of the internal V-shaped walls counteracts the upward forces generated by the lateral compression of the semicircular walls. Thus, the central portions of the upper semicircular walls are maintained in substantially constant position vertically. Since the central portions of the semicircular walls are prevented from deforming upwardly by the downward force of the internal V-shaped walls, the compressive forces instead distort the normally downwardly curved portions of the semicircular walls upwardly, which, in conjunction with the lateral compression of the semicircular walls, forms an upper wall section which is substantially planar and continuous.

The compression seal of the present invention further includes V-shaped stress relief indentations formed at the apexes of the upper semicircular walls. These stress relief indentations are substantially closed under the partial compression of the seal when the adjacent structures are fully contracted. As the adjacent elements expand, the stress relief indentations help to control the direction in which the seal collapses under pressure, further insuring a continuous and substantially planar upper surface.

Thus, it is an object of the present invention to provide an improved compression seal for use in expansion joints between adjacent dynamic structures.

It is a further object of the present invention to provide a compression seal having an upper surface which does not distort vertically as the seal is compressed.

It is yet another object of the present invention to provide a compression seal having a substantially planar upper surface free of interruptions which might cause a hazard to pedestrian traffic.

Other objects, features, and advantages of the present invention will become apparent upon reading the following specification when taken into conjunction with the drawing the appended claims.

DETAILED DESCRIPTION OF THE DISCLOSED EMBODIMENT

Figure 1:
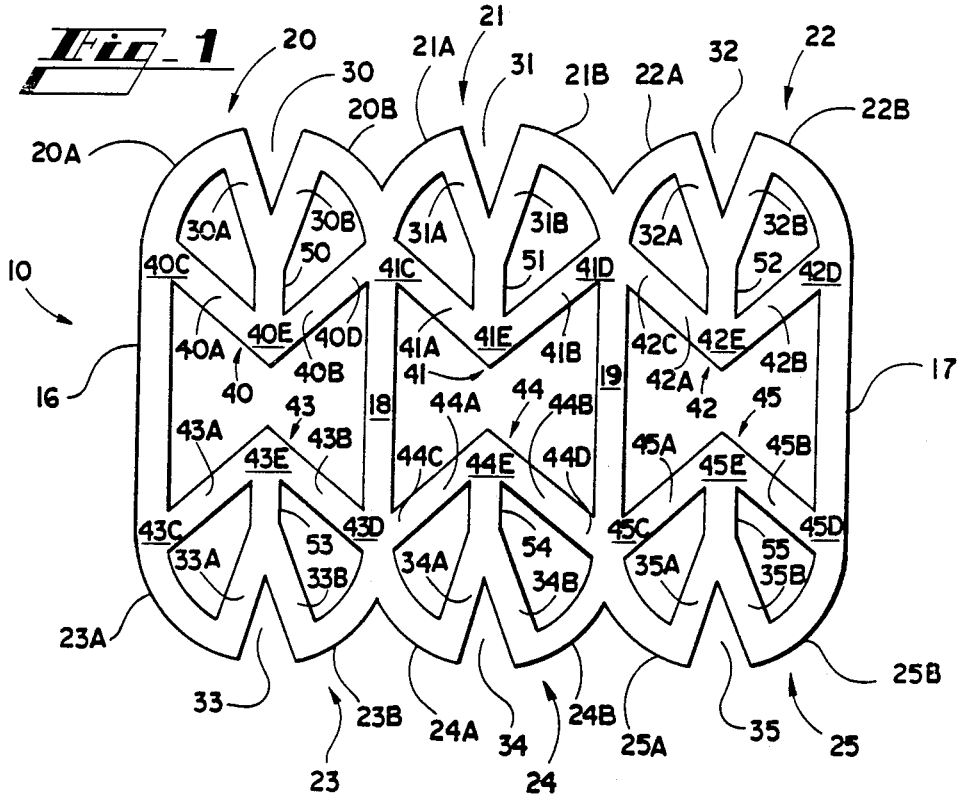
FIG. 1 shows an end view of a compression seal according to the present invention at its nominal width.
Figure 2:
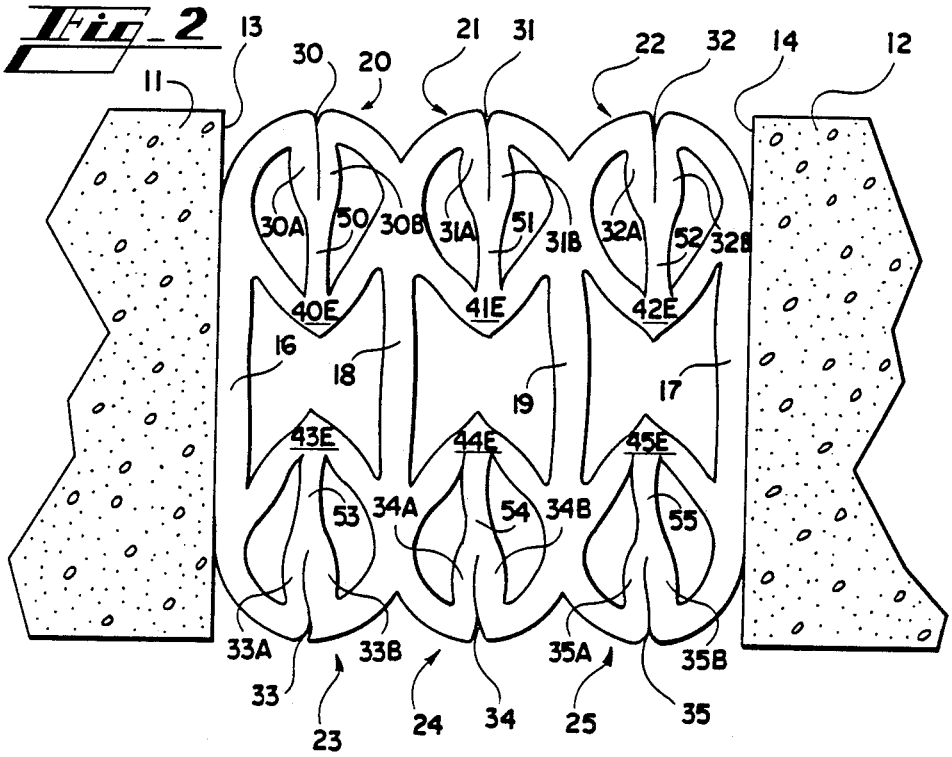
FIG. 2 is an end view of the compression seal of FIG. 1 installed between adjacent dynamic members and laterally compressed to 80% of its nominal width.
Figure 3:
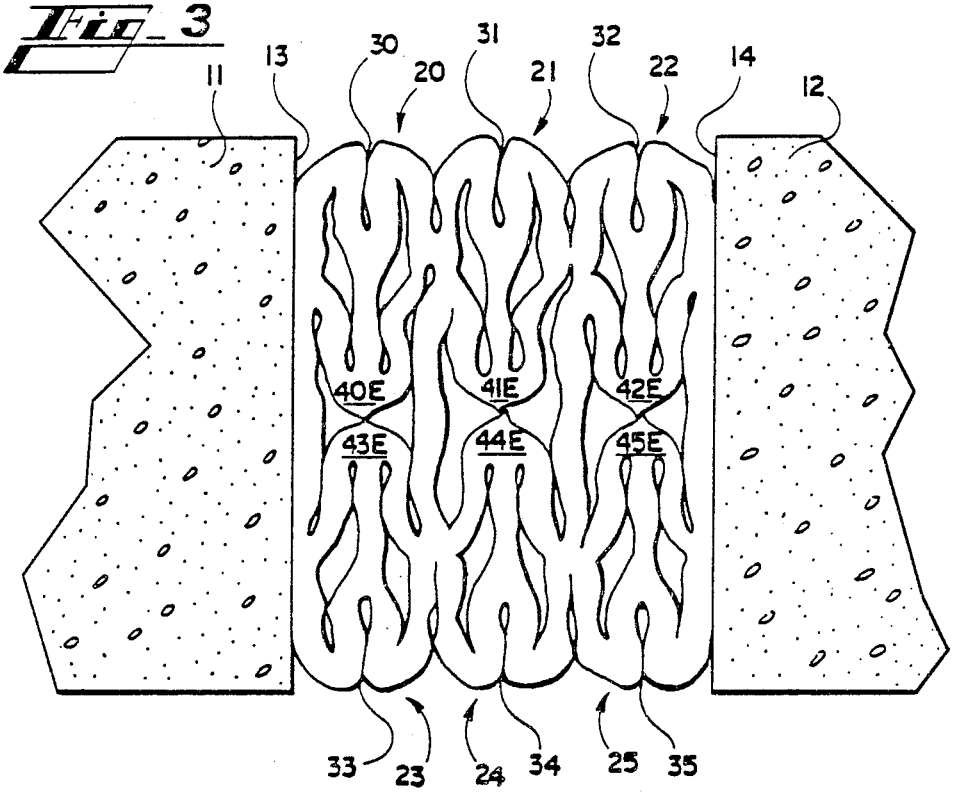
FIG. 3 is an end view of the compression seal of FIG. 1 installed between adjacent dynamic members and laterally compressed to 50% of its nominal width.

Referring now in more detail to the drawing, in which like numerals indicate like elements throughout the several views, FIGS. 1–3 show a compression seal 10 for sealing a void between adjacent dynamic members 11, 12 having mutually facing vertical walls 13, 14, such as concrete slabs in bridges, parking decks and the like. The compression seal 10 is an elastomeric extrusion of indeterminate length formed from neoprene or the like.

The seal 10 has a generally rectangular cross-sectional shape and includes vertical side walls 16, 17. These vertical side walls form vertical surfaces of the compression seal 10 which contact the mutually facing vertical walls 13, 14 of the adjacent dynamic members 11, 12. The seal further includes interior vertical walls 18, 19.

Connecting the tops of adjacent vertical walls 16, 18 is a convex wall 20 of substantially semicircular configuration consisting of arcuate wall sections 20A, 20B. Similarly, a convex wall 21 comprising arcuate wall sections 21A, 21B connects the tops of adjacent vertical walls 18, 19, and a convex wall comprising arcuate wall sections 22A, 22B connects the tops of adjacent vertical wall members 19, 17. In a similar manner, a substantially semicircular lower convex wall 23 comprising arcuate wall sections 23A, 23B connects the bottoms of vertical walls 16, 18. A convex wall 24 comprising arcuate wall sections 24A, 24B connects the bottoms of vertical wall sections 18, 19, and a convex wall 25 comprising arcuate wall sections 25A, 25B connects the bottoms of vertical wall members 19, 17.

A V-shaped stress-relief indentation 30 is formed in the upper convex wall 20 by wall sections 30A, 30B depending downwardly from the arcuate wall sections 20A, 20B. In a similar manner, V-shaped stress-relief indentations 31, 32 defined by wall sections 31A, 31B and 32A, 32B are formed in the upper convex walls 21, 22. V-shaped stress-relief indentations 33, 34, 35 defined by wall sections 33A, 33B, 34A, 34B, and 35A, 35B are formed in the lower convex walls 23–25. These stress-relief indentations absorb the first 20% of the lateral compression of the convex walls, permitting the seal to be compressed to 80% of its nominal width for installation between the adjacent concrete slabs without causing a vertical elongation of the semicircular upper and lower convex walls.

Once the stress-relief indentations 30–35 are closed, any further lateral compression of the seal 10 would tend to elongate the upper and lower convex walls 20–25 vertically, deforming the semicircles into eliptical shapes. To counteract this tendency, internal V-shaped walls 40–45 are provided for controlling the collapse of the convex walls as the seal is compressed. The downwardly-extending V-shaped wall 40 comprising wall members 40A, 40B is joined at its upper edges 40C, 40D to the vertical wall members 16, 18. The wall members 40A, 40B comprising the downwardly extending V-shaped wall 40 converge at an apex 40E. In a similar manner, downwardly-extending V-shaped walls 41, 42 comprising wall members 41A, 41B and 42A, 42B are joined at their upper edges 41C, 41D and 42C, 42D to the vertical wall members 18, 19 and 19, 17 respectively. The wall members 41A, 41B and 42A, 42B of the downwardly-extending V-shaped walls 41, 42 converge at apexes 41E, 42E.

In the same manner as hereinabove described for the downwardly-extending V-shaped walls 40–42, upwardly extending V-shaped wall 43 comprises wall members 43A, 43B joined at their lower edges 43C, 43D to the vertical wall members 16, 18. The upper edges of the wall members 43A, 43B converge at an apex 43E. The upwardly-extending V-shaped wall 44 comprises wall members 44A, 44B which are joined at their lower edges 44C, 44D to vertical wall members 18, 19. Upwardly extending V-shaped wall 44 has an apex 44E. Finally, the upwardly extending V-shaped wall 45 comprises wall members 45A, 45B joined at their upper edges 45C, 45D to the vertical wall members 19, 17, and has an apex 45E.

Referring now to the downwardly-extending V-shaped wall 40, the apex 40E of the V-shaped wall 40 is connected to the upper convex wall 20 by a vertical connecting element 50 linking the apex 40E and arcuate wall sections 20A, 20B through wall members 30A, 30B. In a similar manner, vertical connecting members 51–55 connect the apexes 41E–45E of the V-shaped walls 41–45 with the convex walls 21–25.

To install the compression seal 10 of the present invention, the seal is compressed and inserted between the adjacent dynamic members 11, 12 such that the vertical side walls 16, 17 of the seal bear against the vertical walls 13, 14 of the adjacent members. The compression seal 10 is designed such that at maximum thermal contraction of the adjacent dynamic members 11, 12, the seal is still compressed to 80% of its nominal width, as shown in FIG. 3. In this configuration, the stress-relief indentations 30–35 in the upper and lower convex walls 20–25 are closed. The constant outward force generated by the resilient seal against the vertical walls 13, 14 of adjacent members 11, 12 maintains the seal 10 in position.

As the adjacent members 11, 12 thermally expand, the seal 10 is compressed. Lateral inward forces exerted by the vertical walls 13, 14 of the adjacent members 11, 12 against the vertical side walls 16, 17 of the seal tend to deform the upper convex walls 20–22 upwardly. If this upward deformation were permitted, the upper surface of the seal would protrude above the top surface of the adjacent structural members, subjecting the seal to the possibility of damage or dislodgment by vehicular traffic and presenting a hazard to pedestrian traffic. However, the internal downwardly-extending V-shaped walls 40–42 counteract this tendency and control the manner in which the upper convex walls 20–22 collapse. With specific reference to internal downwardly-extending V-shaped wall 40 for purposes of example, as the seal 10 is compressed, the V-shaped wall 40 collapses. The upper edges 40C, 40D of the wall members 40A, 40B are fixed by their connection to the vertical walls 16, 18. As the V-shaped wall 40 collapses, the apex 40E is displaced downwardly. The downward forces generated by the downward displacement of the apex 40E are transmitted by the vertical connecting member 50 and the wall members 30A, 30B to the central portion of the upper convex wall 20. This downward force negates the tendency of the convex wall 20 to elongate upwardly in response to lateral compression of the seal. It will be appreciated that internal downwardly-extending V-shaped walls 41, 42 exert similar downward forces upon compression of the seal 10, which forces are transmitted through vertical connecting members 51, 52 and the wall members 31A, 31B and 32A, 32B to negate the tendency of the convex walls 21, 22 to elongate upwardly as the seal is compressed.

With the central sections of the upper convex walls 20–22 thus restricted from upward elongation, lateral compression of the seal 10 results in the lower edges of the arcuate wall sections 20A, 20B, 21A, 21B, and 22A, 22B being deformed upwardly. This upward deformation of the lower edges of the arcuate wall sections, in conjunction with the absence of upward elongation of the central portions of the convex walls 20–22, provides an upper surface which is substantially planar and free of voids or interruptions, as shown in FIG. 3. The controlled collapse provided by the downwardly extending internal V-shaped walls 40–42 prevents the upper convex walls 20–22 from distending above the top surface of the adjacent structural elements 11, 12. Thus, the seal 10 provides a suitable treadway which does not protrude upwardly to trip pedestrians and which is free of voids or interruptions into which a woman's high heel may become lodged. The controlled collapse of the seal further makes it suitable for vehicular traffic, since the absence of upward distention prevents the seal from being damaged or dislodged by a snow plow or the like.

It will be appreciated that the collapse of the lower convex walls 23–25 is similarly controlled by upwardly-extending V-shaped walls 43–45. The lower edges 43C, 43D, 44C, 44D, and 45C, 45D of these V-shaped walls being fixed, the apexes 43E, 44E, 45E are displaced upwardly upon lateral compression of the seal, this upward force being transmitted by vertical members 53–55 through wall members 33A, 33B, 34A, 34B, and 35A, 35B to prevent the lower convex walls 23–25 from being elongated downwardly. However, inasmuch as the lower walls of the seal do not provide a pedestrian treadway and are not exposed to the hazards of vehicular traffic, controlling the collapse of the lower convex walls is not essential to the operation of the compression seal 10 of the present invention. The primary benefit of the lower wall arrangement resides in the symmetry of the seal 10 about its horizontal midline, whereby the seal cannot possibly be installed upside down by an unskilled or careless worker.

It should be noted that the opposing pairs of upper and lower V-shaped walls 40 and 43, 41 and 44, and 42 and 45 comprise opposing disconnected angles. Connection or contact between the upper and lower V-shaped walls would impede the ability of the V-shaped walls to displace their apexes inwardly as the seal is laterally compressed, and would thus impair their ability to control the collapse of the upper and lower convex walls.

The compression seal 10 of the present invention is designed such that, at the point of maximum thermal expansion of the adjacent dynamic members 11, 12, the seal is compressed to 50% of its nominal width, as shown in FIG. 3.

Figure 4:
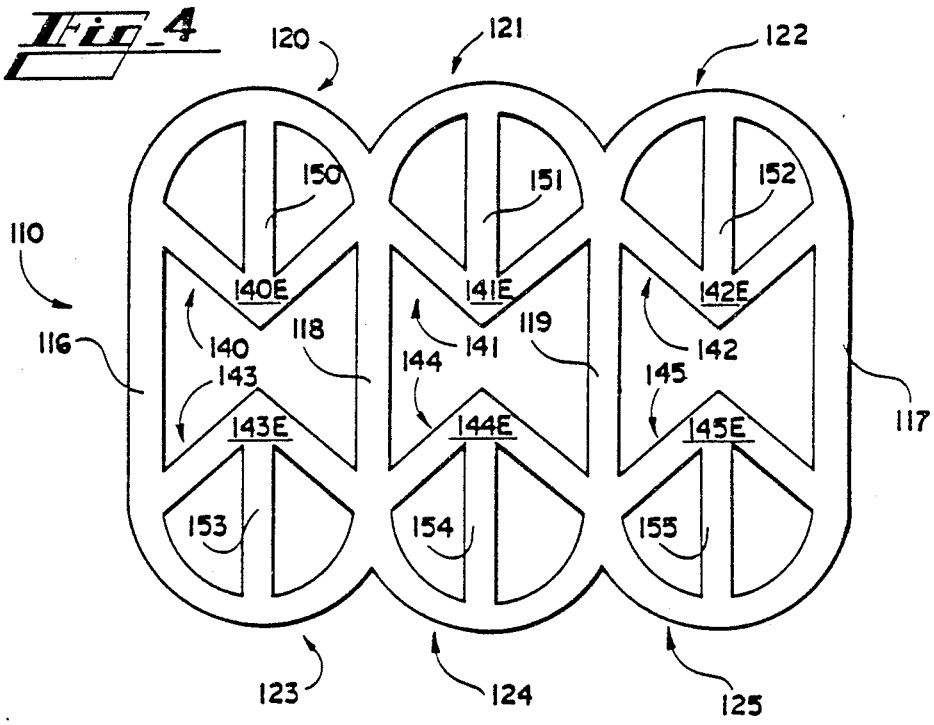
FIG. 4 is an end view of an alternate embodiment of a compression seal according to the present invention.

While the V-shaped stress-relie indentations 30–35 in the convex walls 20–25 absorb the first 20% of the seal's compression without causing a vertical elongation of the convex walls, it will be appreciated that the stress-relief indentations are not essential to the functioning of the seal. Accordingly, an alternate embodiment of a compression seal 110 according to the present invention, as shown in FIG. 4, eliminates the stress relief indentations in the convex walls and relies exclusively upon the internal V-shaped walls and the horizontal connecting elements to prevent vertical elongation of the convex walls even during the first 20% of the seal's compression. The seal 110 includes vertical wall members 116–119, the upper and lower ends of which are connected by convex walls 120–125. Downwardly extending internal V-shaped walls 140–142 are joined to the vertical walls 116–119 at their upper ends. The apexes 140E, 141E, 142E of the V-shaped walls 140–142 are thus displaced downwardly as the seal 110 is laterally compressed. This downward force is transmitted to the central portion of the upper convex walls 120–122 by vertical connecting members 150–152. In a similar manner, upwardly extending V-shaped walls 143–145 are joined to the vertical wall members 116–119 at their lower edges and have apexes 143E, 144E, 145E upwardly displaceable upon compression of the seal. This upward force is transmitted to the lower convex walls 123–125 by vertical connecting members 153–155.

The installation and function of the compression seal 110 is similar to the installation and function of the compression seal 10 with the exception that the seal is entirely dependent upon the internal V-shaped walls 140–145 and the vertical connecting members 150–155 to control the collapse of the convex upper and lower walls 120–125 even during the first 20% of the seal's compression.

While the compression seals described herein are disclosed with respect to a multiplex of three identical congruently linked cells, it will be appreciated that seals including a greater or lesser number of cells may be employed without departing from the scope and spirit of the appended claims. Furthermore, while the utilization of internal V-shaped walls is disclosed with respect to controlling the collapse of convex upper wall sections to provide a substantially planar upper treadway, such V-shaped internal wall members may be employed in conjunction with upper wall sections of different configurations to control the collapse of a seal, even where it is not desirable or necessary to provide a substantially planar upper surface.

Finally, it will be understood that the preferred embodiment of the present invention has been disclosed by way of example, and that other modifications may occur to those skilled in the art without departing from the scope and spirit of the appended claims.

What is claimed is:

1. An apparatus for sealing a void between adjacent dynamic members having mutually facing vertical walls, said sealing apparatus produced as an elastomeric extrusion of generally rectangular cross-sectional shape having a wall construction comprising;

a plurality of vertical walls disposed in adjacent spaced-apart relation, the outermost vertical walls comprising vertical surfaces of said sealing apparatus which contact said mutually facing vertical walls of said adjacent dynamic members;

convex walls extending between the tops of adjacent vertical walls;

each convex wall having its end portions each merging with a respective top;

downwardly-extending V-shaped walls the upper edges of which are connected to adjacent vertical walls such that the apexes of said V-shaped walls are displaced downwardly in response to lateral compression of said sealing apparatus; and means for connecting the apexes of said V-shaped walls and a central portion of said convex walls to exert a downward force on the central portion of said convex walls as said sealing apparatus is laterally compressed to negate the tendency of said convex walls to elongate upwardly as said sealing apparatus is laterally compressed, whereby the collapse of said convex walls in response to lateral compression of said sealing apparatus is controlled to form a substantially planar upper surface connecting said adjacent dynamic members.

2. The sealing apparatus of claim 1, wherein said convex walls comprise upper convex walls, and wherein said V-shaped walls comprise upper V-shaped walls, and further comprising:

lower convex walls extending between the bottom of adjacent vertical walls;

each lower convex wall having its end portions each merging with a respective bottom;

upwardly-extending lower V-shaped walls the lower edges of which are connected to adjacent vertical walls such that the apexes of said lower V-shaped walls are displaced upwardly in response to lateral compression of said sealing apparatus; and means for connecting the apexes of said lower V-shaped walls and the central portion of said lower convex walls to negate the tendency of said lower convex walls to elongate downwardly as said sealing apparatus is laterally compressed.

3. The sealing apparatus of claim 1, further comprising stress-relieving means operatively associated with said convex walls for absorbing a partial compression of said sealing apparatus to prevent said convex walls from vertically elongating as said sealing apparatus is partially laterally compressed for installation between said adjacent dynamic members.

4. The sealing apparatus of claim 3, wherein said stress-relieving means operatively associated with said convex walls comprises interruptions formed in the central portions of said convex walls.

5. The sealing apparatus of claim 4, wherein said interruptions comprise V-shaped indentations.

6. In a compression seal for installation in a void between adjacent dynamic members having mutually facing vertical walls, said compression seal produced as an elastomeric extrusion of generally rectangular cross section having a plurality of substantially vertical wall members and upper wall members connecting the tops of adjacent vertical wall members, an apparatus for controlling the collapse of said upper wall members of said compression seal as said seal is laterally compressed, comprising:

downwardly-extending V-shaped walls the upper edges of which are connected to adjacent vertical walls such that the apexes of said V-shaped walls are displaced downwardly in response to lateral compression of said seal; and vertical connecting members connecting the apexes of said V-shaped walls and an intermediate portion of said upper wall members, whereby the downward displacement of the apexes of said V-shaped walls is transmitted by said vertical connecting members to exert a downward force upon said intermediate portion of said upper walls to control the collapse of said upper walls and said seal is laterally compressed.

7. An apparatus for sealing a void between adjacent dynamic members having mutually facing vertical walls, said sealing apparatus produced as an elastomeric extrusion of generally rectangular cross-sectional shape having a wall construction comprising:

a plurality of vertical walls disposed in adjacent spaced-apart relation, the outermost vertical walls comprising vertical surfaces of said sealing apparatus which contact said mutually facing vertical walls of said adjacent dynamic members;

upwardly-extending arcuate walls having substantially semicircular configurations extending between the tops of adjacent vertical walls; each upwardly-extending arcuate wall having its end portions each merging with a respective top;

downwardly-extending V-shaped walls the upper edges of which are connected to adjacent vertical walls proximate their upper ends such that the apexes of said downwardly-extending V-shaped walls are displaced downwardly in response to lateral compression of said sealing apparatus;

vertical connecting members connecting the apexes of said downwardly-extending V-shaped walls and the central portions of said upwardly-extending arcuate walls;

downwardly-extending arcuate walls having substantially semicircular configurations extending between the bottoms of adjacent vertical walls;

each downwardly -extending arcuate wall having its end portions each merging with a respective top;

upwardly-extending V-shaped walls the lower edges of which are connected to adjacent vertical walls proximate the lower ends such that the apexes of said upwardly-extending V-shaped walls are displaced upwardly in response to lateral compression of said sealing apparatus; and vertical connecting members connecting the apexes of said upwardly-extending V-shaped walls and the central portions of said downwardly-extending arcuate walls, whereby the tendency of said arcuate walls to elongate vertically as said sealing apparatus is laterally compressed is negated.

8. The sealing apparatus of claim 7, further comprising V-shaped indentations formed in the central portions of said arcuate walls for absorbing a partial compression of said sealing apparatus to enable said arcuate walls to maintain said substantially semicircular configuration without vertically elongating as said sealing apparatus is partially laterally compressed for installation between said adjacent dynamic members.

* * * * *